US005975030A

United States Patent [19]

Wernig et al.

[11] Patent Number: 5,975,030

[45] Date of Patent: Nov. 2, 1999

[54] LOW-PRESSURE FEEDWATER PREHEATER

[75] Inventors: Herbert Wernig, Dübendorf; Mustafa Youssef, Zürich, both of Switzerland

[73] Assignee: Asea Brown Boveri AG, Baden, Switzerland

[21] Appl. No.: 09/168,995

[22] Filed: Oct. 9, 1998

[30] Foreign Application Priority Data

Oct. 9, 1997 [EP] European Pat. Off. ..... 97810761

[51] Int. Cl.[6] ..... F22B 17/16

[52] U.S. Cl. ..... 122/512; 122/32

[58] Field of Search ..... 122/32, 406.3, 122/412, 511, 512

[56] References Cited

U.S. PATENT DOCUMENTS

| | | | |
|---|---|---|---|
| 2,995,341 | 8/1961 | Danesi . | |
| 3,630,276 | 12/1971 | Paine et al. | 122/32 |
| 3,683,866 | 8/1972 | Zmola | 122/32 |
| 4,170,263 | 10/1979 | Laber et al. | 122/512 |
| 4,357,908 | 11/1982 | Yazidjian | 122/32 |
| 5,042,433 | 8/1991 | Monnier | 122/511 |

FOREIGN PATENT DOCUMENTS

| | | |
|---|---|---|
| 2458437 | 2/1976 | Germany . |
| 2820736 | 11/1979 | Germany . |
| 393366 | 10/1965 | Switzerland . |

*Primary Examiner*—Teresa Walberg
*Assistant Examiner*—Gregory A. Wilson
*Attorney, Agent, or Firm*—Burns, Doane, Swecker & Mathis, L.L.P.

[57] ABSTRACT

A low-pressure feedwater preheater or heater in power station plants, heated with bleed steam and having a two-pass tube bundle of the tube sheet type of construction, has a carrier design for the tube bundle having side plates (9) running parallel to the tube bundle and one or more supporting plates (8) disposed perpendicularly to the tube bundle. In the center of the bundle between the cold and the hot leg, a partition (11) extends along the entire length of the bundle leg. Arranged on either side of the partition (11) are suction tubes (12) through which non-condensable gases are drawn off in the zones of lowest pressure. According to the invention, the supporting plates (8) are each made of a single piece and are thus continuous, and the partition (11) consists of individual sheet-metal parts which are connected to the supporting plates (8). In one embodiment, the sheet-metal parts of the partition (11) and the supporting plate (8) are connected to one another by indentations (16) on each side of the sheet-metal part (11) which faces the supporting plate (8) and by a corresponding opening (17) in the supporting plate (8).

7 Claims, 2 Drawing Sheets

FIG. 2
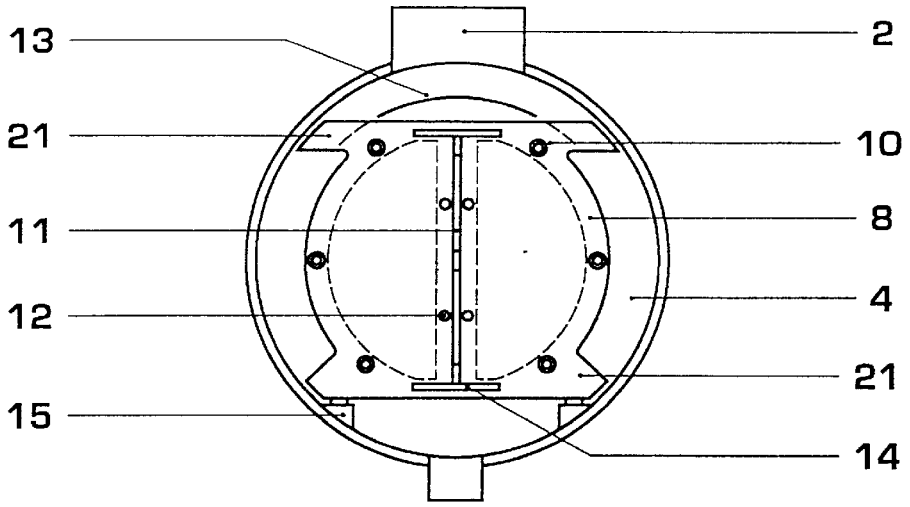
FIG. 3
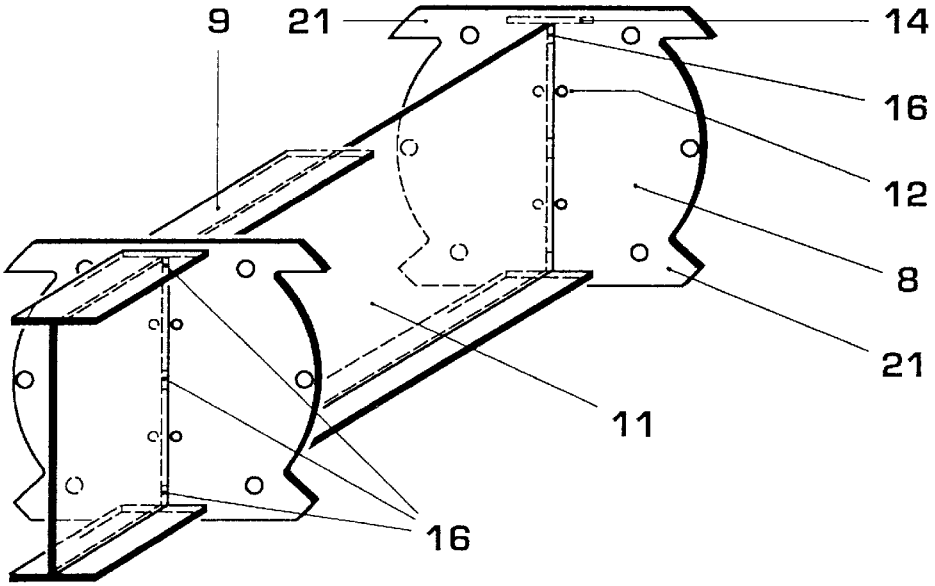
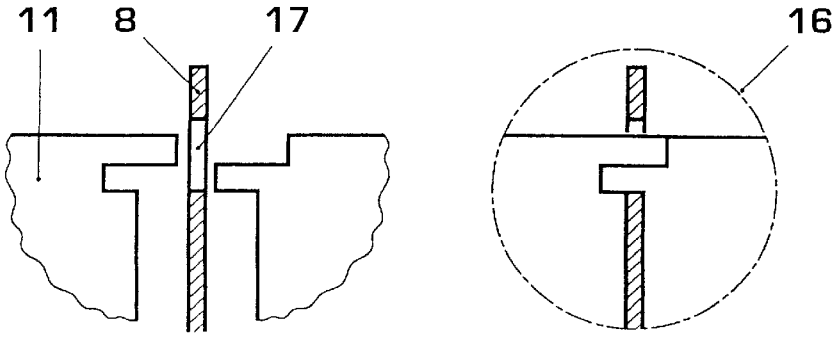
FIG. 4

LOW-PRESSURE FEEDWATER PREHEATER

BACKGROUND OF THE INVENTION

1. Field of the Invention

The invention relates to a low-pressure feedwater preheater or district heater, which is heated by bleed steam and has two-pass tube bundles of the tube-sheet type of construction, for power station plants and relates in particular to a design for the tube-bundle carrier.

2. Discussion of Background

Low-pressure feedwater preheaters are generally known. They are arranged in a power station plant between the condenser and the deaerator/feedwatertank and serve to preheat the feedwater in a steam/water circuit by heat exchange between steam and feedwater flowing in tubes. To this end, the steam is bled from a low-pressure turbine and directed into the preheater, where it condenses on the tubes and heats the feedwater. In a district-heating power station, the heater serves to reheat heating water which flows through a district-heating circuit.

Air (non-condensable gases) passes with the bled steam as well as from the atmosphere, in particular in the case of preheaters operated in the vacuum range, into the preheater and hinders the heat transfer. This hindrance is removed by deaearation of the apparatus by drawing off these non-condensable gases, for which reason various measures have to be taken in order to carry away the gases as completely as possible.

The feedwater flows via a two-pass system from a water box which is subdivided into two parts and is arranged at one end of the preheater. This two-pass system consists of a bundle of tubes, which are either designed in a straight line together with a reverse flow water box or are of U-shaped design. The water flows from the first part of the water box through the tubes via the revese flow water box or via the U back into the second part of the water box, the cold half of the tubes being designated as cold leg and the hot half being designated as hot leg. In feedwater preheaters of the tube-sheet type of construction, the tube bundles are each firmly anchored in a plate which is arranged in a position adjacent to the water box. Furthermore, the tubes are held and supported by tube carriers, which in each case consist of supporting plates and longitudinal support bars.

The steam bled from the turbine passes through the steam inlet opening into the low-pressure feedwater preheater and is distributed by a baffle plate, so that it first of all flows into an annular steam space between the shell and the tube bundle and then penetrates radially into the tube bundle along the entire length of the latter and condenses on the tube surfaces. There is a free space, the so-called bundle lane, in the center of the tube bundle. Direct inflow of the steam into the bundle lane is prevented by side plates arranged on the outside. Arranged in the bundle lane are one or more deaeration tubes. The latter have a plurality of suction openings through which the non-condensable gases are drawn off. The gases collect in the zone in which the lowest pressure prevails. It has been found that the zone of lowest pressure does not run parallel to the tubes and along the center of the bundle lane but shifts gradually from the center of the bundle to the cold leg of the tube bundle. It therefore runs obliquely from the center of the deflection side of the tubes to the cold inlet side of the tubes at the water box. It is not possible to place a suction tube ideally in this zone of lowest pressure, since such a suction tube would have to be placed at the tube-sheet side on or in the cold leg.

Described in DE 28 20 736 is a feedwater preheater which, in the bundle lane between the cold and the hot leg of the tube bundle, has a partition which extends along the entire length of the tube bundle. Due to the partition, a zone of lowest pressure which does not extend into the tube bundle is obtained in the bundle lane on either side of and in proximity to the partition. Here, suction tubes having deaeration openings through which the non-condensable gases are drawn off are arranged on each side of the partition. This ensures that there are deaeration tubes at the points of lowest pressure in both the hot and the cold bundle half.

The partition, which is continuous over the bundle length, is welded to the side plates of the bundle carriers. The perforated supporting plate consisting of two halves is likewise welded to the side plates and the partition. From the technical point of view, the welded joints are readily suitable for this type of preheater; however, the fabrication of the bundle carriers with this welded construction is very time-consuming, involves a great deal of work and is very costly.

SUMMARY OF THE INVENTION

Accordingly, one object of the invention is to avoid the high cost for the fabrication of the bundle carriers having a partition and to find a design for the bundle carriers whose fabrication is as simple and as cost-effective as possible and in particular requires as little welding work as possible or no welding work.

This object is achieved according to the invention by a low-pressure feedwater preheater or heater according to the preamble of the main claim, the two-pass tube bundle of which has a bundle-carrier design whose supporting plates are each made of a single piece and are thus continuous, and the partition consists of individual sheet-metal parts which are arranged between the side plates and these supporting plates.

In one embodiment of the invention, the sheet-metal parts of the partition are mechanically guided in the supporting plates by an indentation. To this end, the sheet-metal parts of the partition have at least one indentation on each of the sides facing the supporting plates, which indentations fit openings in the supporting plate. The side plates, like the supporting plates, are also each made of a single piece and are guided by the supporting plate.

This design of the bundle carrier has the advantage that the individual parts, the supporting plates, partition parts and side plates are each made of one piece and are as far as possible assembled without a further machine operation. The complex welding work is omitted, and greatly simplified assembly of the bundle carrier, with time saved and costs significantly reduced, results.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 shows a cross section of a feedwater preheater according to FIG. 1, FIG. 3 shows a bundle carrier in perspective according to the invention, FIG. 4 shows a detail view of the indentation of two sheet-metal parts of the partition with a supporting plate.

DESCRIPTION OF THE PREFERRED EMBODIMENTS

Figure 1A:
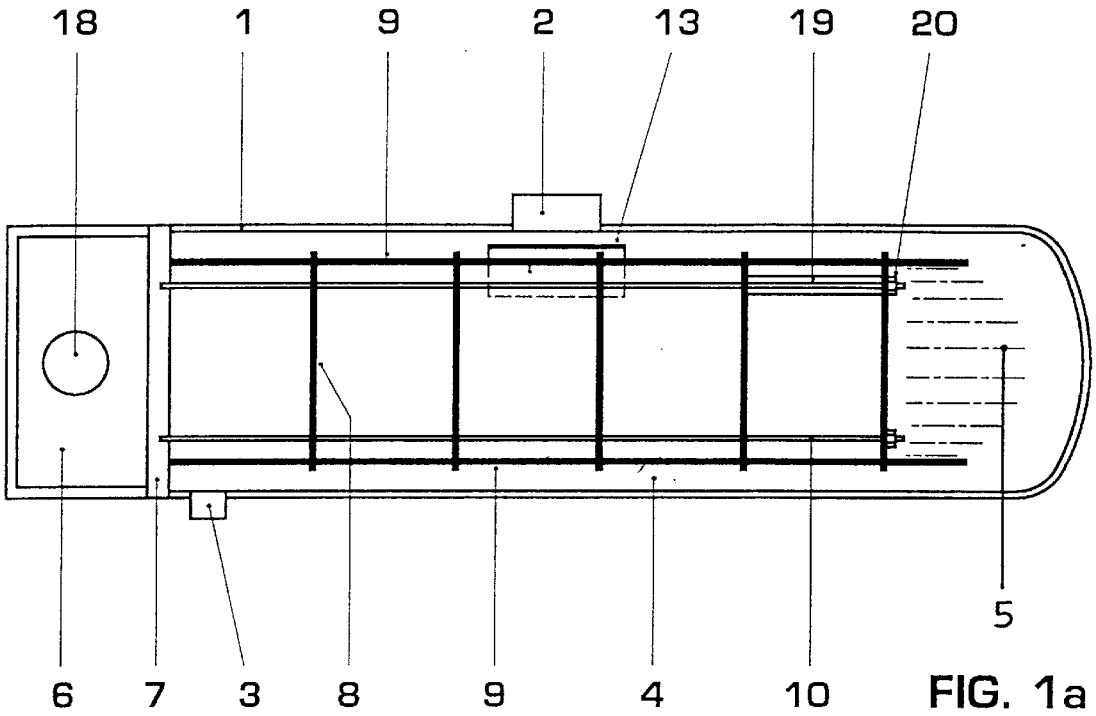
FIGS. 1 *a*) and *b*) show axial longitudinal sections through a low-pressure feedwater preheater, disposed at 90ø to one another.
Figure 1B:
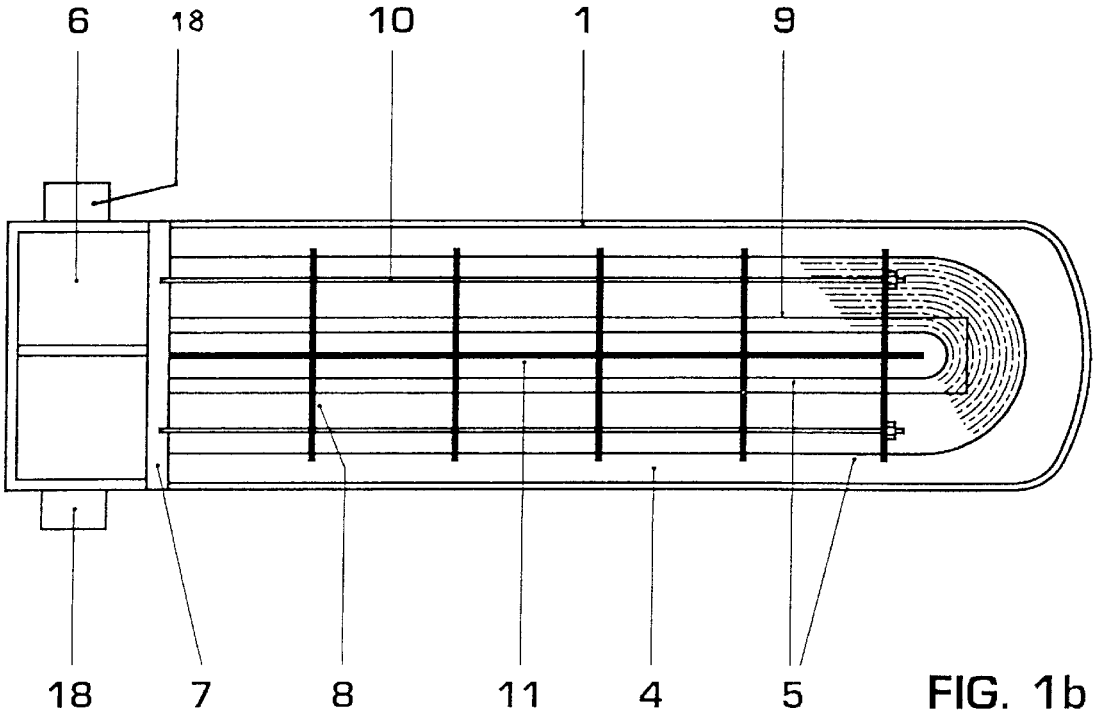

Referring now to the drawings, wherein like reference numerals designate identical or corresponding parts throughout the several views, the feedwater preheater in FIGS. 1 *a*), *b*) and 2 has a steam inlet opening 2 and a condensate outlet opening 3 in its steam shell 1. The steam shell 1 encloses a steam space 4 and a tube bundle 5. Arranged at the steam inlet opening 2 is a cylindrically arched baffle plate 13, by means of which the incoming steam is deflected into the steam space 4 and does not subject the tube bundle 5 to direct flow. A subdivided water box 6 having inlet and outlet openings 18 is arranged at one end of the preheater, from which water box 6 the feedwater flows through the two legs of the tube bundle 5 and back into the water box. The tube bundle 5 is anchored in a tube sheet 7 and supported by a tube-bundle carrier, which has supporting plates 8 and side plates 9. Furthermore, the supporting plates 8 are held together by tie rods 10 having spacer sleeves 19 and nuts 20. A partition 11 is arranged between the tube legs in the bundle lane, and suction tubes 12 for deaerating the steam are provided on either side of the partition 11. As already mentioned, the zone of lowest pressure forms here, so that the non-condensable gases collect in this zone and are carried away through openings in the suction tubes 12. FIG. 2 shows the profile of a supporting plate 8 having drilled openings for the suction tubes 12 and the tie rods 10 as well as milled slotted openings 14 for the side plates 9. The outline of the perforation for the tube bundle is indicated by broken lines. Furthermore, the supporting plates 8 are supported on two angles 15, which are arranged on the wall of the steam shell 1 and on which the supporting plates 8 can move freely with the tube bundle 5 in longitudinal and transverse direction as a result of the unequal thermal expansion of the hot and the cold tube leg. The supporting plate 8 also has four supports 21 in the form of lobes in order to laterally guide the bundle carriers on the wall of the steam shell 1. The supports 21 are each formed in such a way that their margin runs parallel to the wall of the steam shell 1. The support 21 does not lie directly on the wall of the steam shell, but rather there is a free or clearance space between it and the wall of the steam shell 1 for displacements of the supporting plates 8 as a result of thermal expansions of the tube bundle. The supporting plate 8, as a result of thermal expansions of the tube bundle 5, may therefore be displaced until the support 21 comes into contact with the wall of the steam shell 1 and is supported there.

FIG. 3 again shows the supporting plates 8 with milled slotted openings 14, through which the side plates 9 are pushed, as well as the drilled openings for the suction tubes 12 and the tie rods 10. The individual sheet-metal parts of the partition 11, for example at all four corners as well as at the center of the edges which face the supporting plate 8, have indentations 16 according to FIG. 4. During assembly, these indentations 16 are inserted into openings 17, adapted to them, in the supporting plate 8. The fastening and guidance of the partition parts 11 in the supporting plates 18 are ensured by the indentations on each side which faces the supporting plate. Of course, apart from the indentation 16 shown having indents shaped at right angles, other indentation shapes, for example indentations having triangular shapes, are also conceivable.

The supporting plates 8 are fixed together by means of tie rods 10, spacer sleeves 19 and nuts 20. The tie rods 10 and spacer sleeves 19 expand as a result of heating and are displaced together with the supporting plates 8 in longitudinal direction. The tubes likewise expand in the longitudinal direction but to a different extent and unevenly due to the different temperatures of the cold and the hot leg, this expansion to a different extent being ensured by the free displacement of the tubes in the supporting plates 8. All the components of the bundle carrier according to the invention, consisting of supporting plates, partition parts, side plates, spacer sleeves and tie rods, are completely prefabricated in the factory and are quickly assembled in a cost-effective manner without welding work (or with as little welding work as possible).

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A low-pressure feedwater preheater or heater in power station plants which is heated by bleed steam, comprising at least one steam inlet opening and condensate outlet opening, which are made in a steam shell, and a two-pass tube bundle of sheet type construction, which has a cold and a hot leg, at least one supporting plate arranged perpendicularly to a bundle axis, and side plates running parallel to the bundle axis, and in which, in a center of the tube bundle between the hot and the cold bundle leg, a partition is arranged along an entire length of the tube legs, wherein the individual supporting plates are each made of a single piece and are continuous, and the partition includes individual sheet-metal parts which are connected to the supporting plates.

2. The low-pressure feedwater preheater or heater as claimed in claim 1, wherein the side plates are each made of a single piece and are continuous and are guided by slotted openings in the supporting plates.

3. The low-pressure feedwater preheater or heater as claimed in claim 1, wherein the individual sheet-metal parts of the partition have one or more indentations on each of the two sides which faces a supporting plate, and each supporting plate has an opening adapted to each of these indentations.

4. The low-pressure feedwater preheater or heater as claimed in claim 1, wherein the supporting plates of the bundle carrier are tightened together by means of tie rods and spacer sleeves between the supporting plates.

5. The low-pressure feedwater preheater or heater as claimed in claim 1, wherein the supporting plates with the tube bundles are supported on two angles arranged on the inner wall of the steam shell, so that the tube bundle moves freely horizontally as a result of thermal expansions.

6. The low-pressure feedwater preheater or heater as claimed in claim 1, wherein each supporting plate has at least four supports, which are arranged with a clearance space relative to the inner wall of the steam shell, which clearance space permits a free displacement of the bundle carrier in longitudinal and transverse direction.

7. The low-pressure feedwater preheater or heater as claimed in claim 1, wherein suction tubes for drawing off non-condensable gases run on either side of the partition in zones of lowest pressure.

* * * * *